United States Patent [19]

Shengqiao

[11] Patent Number: 4,960,980

[45] Date of Patent: Oct. 2, 1990

[54] BIOCLOCK CALCULATING DEVICE FOR HUMAN BODY

[76] Inventor: Fu Shengqiao, Physics Department, Xiangtan University, Hunan, China

[21] Appl. No.: 282,558

[22] Filed: Dec. 12, 1988

[30] Foreign Application Priority Data

Dec. 18, 1987 [CN] China ..... 87107512

[51] Int. Cl.[5] ..... G06C 3/00

[52] U.S. Cl. ..... 235/78 RC; 235/88 RC; 235/116; 235/119

[58] Field of Search ..... 235/61 B, 76, 78 RC, 235/88 RC, 85 FC, 109, 119, 136, 88 R, 116, 117 A, 122

[56] References Cited

U.S. PATENT DOCUMENTS

| | | | |
|---|---|---|---|
| 3,157,354 | 11/1964 | Henry | 235/119 |
| 3,253,780 | 5/1966 | Stewart et al. | 235/88 R |
| 3,276,682 | 10/1966 | Phelps | 235/76 X |
| 3,821,521 | 6/1974 | Riehl | 235/119 |
| 4,240,153 | 12/1980 | Merritt | 235/85 FC X |
| 4,551,620 | 11/1985 | Rashev | 235/85 FC X |

*Primary Examiner*—Benjamin R. Fuller

[57] ABSTRACT

A new type of bioclock calculating device for the human body comprising a ring, a set of discs and some accessories. They are marked with data graduation, age graduation and curves showing the cycles of physical, emotional and intellectual (PEI) rhythms. When superimposed eccentrically set into planetary revolutions, the discs will provide instant information about an individual's PEI rhythms on any day in any year and show the continual distribution of the curves over many years. It may also be used for a comparative study of PEI rhythms between two persons.

13 Claims, 2 Drawing Sheets

FIG. 1
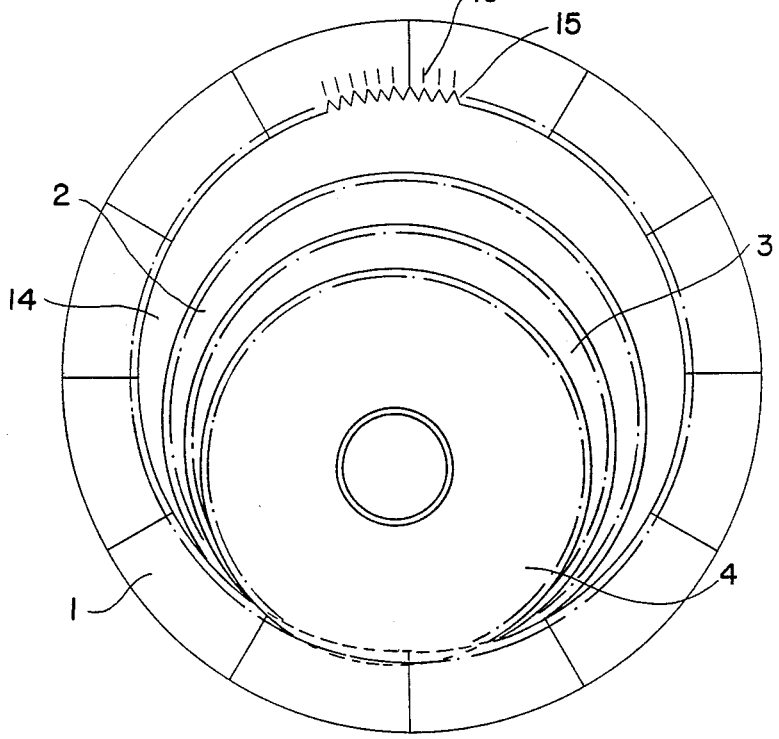
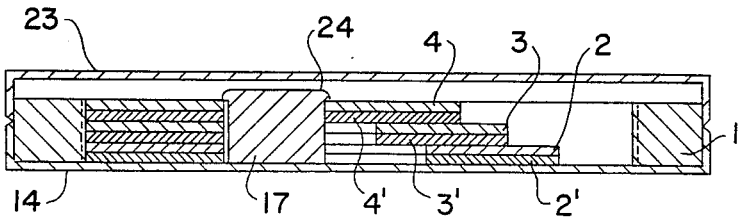
FIG. 5

FIG. 2
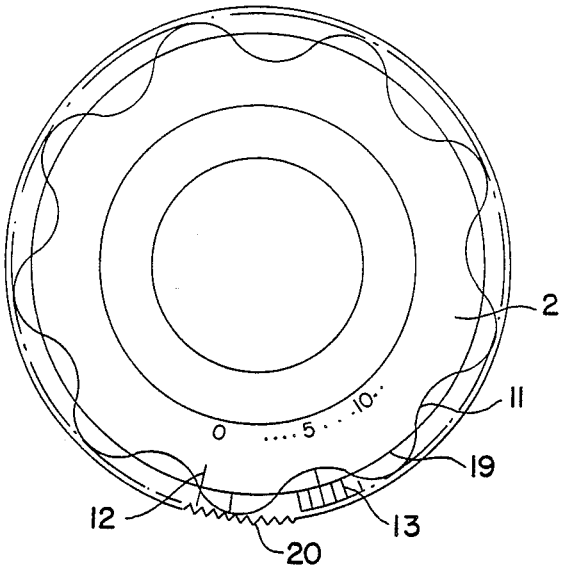
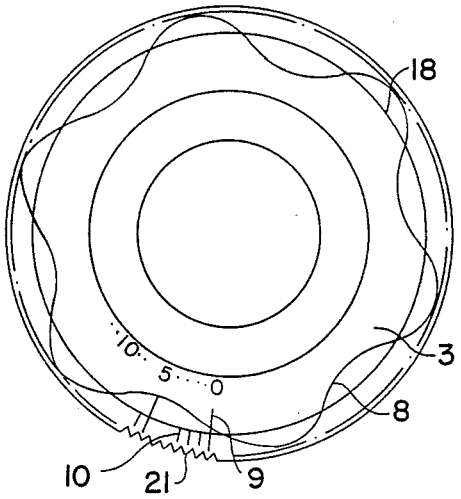
FIG. 3
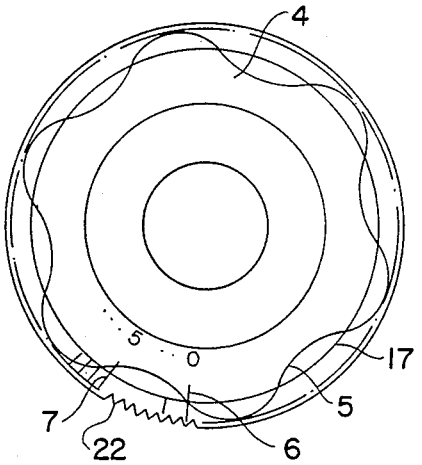
FIG. 4

BIOCLOCK CALCULATING DEVICE FOR HUMAN BODY

BACKGROUND OF THE INVENTION

1. Field of the Invention

The present invention refers to a device for the calculation of bioclock rhythms in the human body. It comprises a date ring within which several cycle discs rotate, so that the calculation is made rapidly with easy operation, direct visual indication and observation continuous over long periods.

2. Description of the Prior Art

It has been proved in science that, starting from the very day of birth, a human being's physical, emotional and intellectual (PEI) rhythms in the body undergo cycles of 23, 28 and 33 days respectively, each cycle consisting of a high-tide period and a low-tide period with a critical day in between. This theory, according to sources of information from the United States, Japan, Switzerland and Italy, has been applied increasingly to various fields of human activity, such as traffic and industrial safety, health care for patients and elderly people, the arrangement of surgical operations, the forecasting of peak conditions in major examinations and sports competitions, and the scheduling of tours and business talks. It has been proved by numerous facts, that scheduling yields good results in the high-tide period much more often than in the low-tide period, particularly on the critical day.

To solve the calculating problems concerning the distribution of PEI rhythms, three categories of devices have been put into use, namely, (1) generally computers, (2) specialized microcomputers, and (3) manually-operatd calculating discs and rulers.

The first category is expensive and requires programing, which results in an unpopular and not a favorable device.

In the second category mention may be made of Kosmos-I produced in USA, Biostar (watch) by Certina Co in Switzerland, Biocom-200 by Takachiko Kokekia Co and Biolator by Casio Co in Japan, and a brand by Olivetti Co in Italy. They have made improvements on the first category in applicability.

The third category, for all their defects are inexpensive and have played a positive role in making such devices popoular.

From the technical point of view, however, an ideal device should, apart from showing the bioclock situation on a given day, meet the following purposes as the occasion may arise:

(1) Indicating the continual distribution of curves over a long period of time up to many years;

(2) Indicating the bioclock situation on a given day some years after or before the present time, for example, in predicting an athlete's peak form during the a future Olympics event for mapping out a long-term training program;

(3) Indicating the overlying curves over a given period for a comprehensive and comparative study so as to uncover the bioclock situation on a particular day(s), as is the case, for instance, with an aging person who wants to know how many duo- or trio-critical days or low-tide periods will occur in future years and when they will occur;

(4) Indicating, in the case of a couple seeking an optimal period for conception, a coincident high-tide period of all the three bioclock cycles for both partners, which involves the rare superimposition of six curves.

These functions cannot be performed by conventional bioclock calculating devices—computerized or non-computerized—unless with the help of general computers, which calls for time-consuming and laborious programming.

SUMMARY OF THE INVENTION

The object of the present invention is to provide a type of multi-purpose bioclock calculating device which supplies, at a high speed and through instant visual indications, PEI information not only about any day in any year, but also about the general situation over any period in one's lifetime; not only about the future for the sake of prediction, but also about the past for the sake of verification; not only about a single person, but also about more than one for the sake of comparative study; a device which is very easy to operate and uncostly for making such devices popular.

The present invention has a peculiar structure with a ring notched with internal teeth, attached to a base disc and marked with the months and days of the year. Within the ring are placed, one upon another, three different cycle discs (or several cycle discs of a particular biorhythm) notched with external teeth and marked with a graduation indicating the age and, respectively, with sine curves showing the PEI cycles. The age graduation is arranged according to strict mathematical operations, taking into account, among other things, compensation for leap years. The three cycle discs are to be placed one upon another in any order, with the external teeth meshed with the internal teeth. The cycle discs have a round hole at the centre through which a pushing piece or any substitute (e.g. a finger) is placed to set the discs into simultaneous independent planetary revolutions on the base disc within the date ring, with the external teeth dovetailed into the internal teeth. All the three curves and graduations on the transparent cycle discs can be perceived simultaneously in relation to the graduation on the date ring, showing a full view of the distribution of PEI rhythms.

The present invention covers a lifetime ranging from zero to 100 years and even beyond when necessary. Once placed in position with the year lines in the age graduation set against the relevant date line on the date ring, the rotating cycle discs will provide instant information needed, without doing any arithmetic operation beforehand. All the PEI rhythms are revealed and distinctly visualized at the same time, through a glance at the graduations and curves.

The present invention is capable of high-speed calculation, taking only a few seconds to find out the distribution of curves on any day in any year and throughout the year, and only a few minutes to make a comprehensive study of the PEI situation over many years in succession. The cycle discs can be set rolling both clockwise to forecast the future and counterclockwise to verify the past for repetitive observations and comparative studies.

For eugenic purposes, another set of cycle discs may be added for a comparative study of PEI rhythms between husband and wife to find out, by setting the six cycle discs into simultaneous motion, an optimal period for conception.

In calulations, the present invention has the same degree of precision as computers and the results agree with those of universally-accepted formulas.

Owing to the transparency of the overlying cycle discs, which makes it possible to detect all the curves and graduations on them, the present invention can be reduced to pocket size for portability.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invenion will become apparent to those skilled in the art from this detailed description.

BRIEF DESCRIPTION OF THE DRAWING

The present invention will become more fully understood from the detailed description given hereinbelow and the accompanying drawings which are given by way of illustration only, and thus are not limitative of the present invention, and wherein:

FIG. 1 is a sketch of the assembly of the present invention;

FIG. 2 is a sketch of the physical cycle disc;

FIG. 3 is a sketch of the emotional cycle disc;

FIG. 4 is a sketch of the intellectual cycle disc.

FIG. 5 is a sketch of a cross-sectional view of the present invention.

DESCRIPTION OF THE PREFERRED EMBODIMENTS

In FIG. 1, the three cycle discs 2, 3 and 4 are superimposed eccentrically on the base disc 4 with the cylindrical pushing piece 17 projecting through central holes therein. When activated by the pushing piece 17 under the influence of an outside force exerted by an individual's finger, an outward force will be produced to mesh the external teeth 20, 21 and 22, as illustrated in FIGS. 2–4, with the internal teeth 15 of the date ring 1. A tangent force will be produced at the same time to drive the cycle discs for rotations and revolutions at different angular velocities to display different combinations of the biorhythm curves on the cycle discs. The date ring 1 is marked with a date graduation 16, in which the long lines indicate the months and the short lines indicate the days, all arrayed in clockwise direction. The date ring 1 has 365 internal teeth 15 corresponding to the number of days of a non-leap year. Each line in the date graduation 16 is set against the lowest point in a groove in the internal teeth 15.

The date ring 1 is attached to the base disc 14, on which are placed, one upon another, the physical cycle disc 2, emotioned cycle disc 3 and intellectual cycle disc 4, all with a hole at the centre for passing through the pushing piece 17.

FIGS. 2, 3 and 4, showing the physical cycle disc 2, the sensitive cycle disc 3 and the intellectual cycle disc 4 respectively, are all notched with external teeth. The number of teeth is a multiple of 23, 28 and 33, the multiplier to be chosen within the limit of 365, that is, ranging from 4 to 14 for disc 2, from 4 to 12 for disc 3, and from 4 to 10 for disc 4. The number of external teeth may be, for instance, 276, 252 and 231 for discs 2, 3 and 4 respectively.

To reflect visually the situations of biorhythms, the cycle discs 2, 3 and 4 are marked on a top surface with a multi-wave curve 11, 8 and 5 on a base circle 19, 18 and 17. Each cycle is represented by a section of the curve, covering 23 tooth grooves for disc 2, 28 tooth grooves for disc 3 and 33 tooth grooves for disc 4. Starting from a point directly above a tooth point, the cycles are drawn forward in clockwise direction in the form of sine curves, with the positive semicycle near the central hole standing for the high-tide period, the negative semicyle near the outer edge of the cycle disc standing for the low-tide period and the point where the base circle 19, 18 and 17 intersect the curves 11, 8 and 5 standing for the critical day. The high-tide and low-tide periods may also be represented by coloured sections.

There are 100 year lines in the age graduation 13, 10 and 7 on the discs 2, 3 and 4, each line set against a tooth point, with the zero-year line 12, 9 and 6 on the starting point of a sine curve and the other year lines arrayed in counterclockwise direction for disc 2 and in clockwise direction for both discs 3 and 4.

All the graduations and curves on the date ring 1 and cycle discs 2, 3 and 4 can be arranged in a direction reverse to that stated above.

The space between two adjacent year lines is determined by the number of tooth grooves it covers—three grooves for the spaces between 0–1, 1–2 and 2–3 years lines on disc 2, one groove for those on disc 3 and two grooves for those on disc 4. Taking into account the compensation for leap years, the space between 3–4 year lines covers two grooves for disc 2, two grooves for disc 3 and three grooves for disc 4. The same principle applies to all the other year lines, that is, those with a number which is not a round multiple of 4 are preceded by three grooves for disc 2, by one groove for disc 3 and by two grooves for disc 4; while those with a number which is a round multiple of 4 are preceded by two grooves for disc 2, two grooves for disc 3, and three grooves for disc 4.

For the purpose of clear distinction, the cycle discs 2, 3 and 4 may each use a different colour for all its year lines and curves—for instance, red, green and blue (or brown). The top surface of the base disc 14 is preferably in white to set off the coloured markings on the cycle discs 2, 3 and 4.

The base disc 14 and pushing piece 17 may be inset with magnetic material to provide a light adhesive force between the two.

For private use, the modulus of the internal and external toothing ranges from 0.2 to 1.0, preferably 0.3–0.6. The thickness of cycle discs 2, 3 and 4 ranges from 0.3 to 3.0 mm. For public use in amusement rooms, the modulus may exceed 1.0, with all the constituent parts enlarged correspondingly.

The constituent parts of the present invention may be made of such materials as plastic, polymethyl methacrylate and metal, provided that the cycle discs 2, 3 and 4 are transparent.

The cross-section view in FIG. 5 shows clearly the correlations between the members of the whole device. The date ring 1, two sets of cycle discs 2/2', 3/3' and 4/4', the cylindrical pushing piece 17 and a transparent cover 23 are supported on the base disc 14. The two sets of cycle discs 2/2', 3/3', and 4/4' are shown for the purpose of identifying two partner's combined biorhythm levels and may be, for other purposes, replaced by only one set of cycle discs or by a number of cycle discs of the same biorhythm. The number of cycle discs to be used may be increased or decreased for different purposes.

The three different kinds of cycle discs 2, 3, 4 or 2', 3', 4', owing to the different numbers of days in related biorhythm cycles, are different in diameter. However, the distance between the edge of the central hole and the outer edge of the disc for all cycle discs 2, 3, 4 or 2', 3', 4' must be the same. Hence the different diameters of the different central holes.

In FIGS. 2–4, the physical, emotional and intellectual rhythm curves 11, 8 and 5 on the cycle discs 2, 3 and 4 are drawn on the base circles 19, 18 and 17. For simplicity's sake, only a portion of the age scales 13, 10 and 7 and the external teeth 20, 21 and 22 are drawn on an enlarged scale.

I claim as my invention:

1. A human biorhythms calculating device comprising:

a base disc;

a date ring fixed on the said base disc includes a face having a calendar scale and internal teeth on an inner edge;

a plurality of cycle discs displaying respectively physical, emotional and intelligent biorhythms of a human body;

each cycle disc includes a central hole of a distinct predetermined size, a number of external teeth corresponding to a number of days in a related biorhythm cycle, and a curve on a surface of each cycle discs representing related biorhythm cycles, and an age scale associated with said biorhythm cycles, at least one set of said cycle discs being superimposed eccentrically within said date ring;

a cylindrical pushing piece positioned through the central holes of said cycle discs for movement within said date ring to exert an outward force on all said cycle discs superimposed within said date ring, so that the external teeth of said cycle discs will be meshed with the internal teeth of said date ring, and providing said cycle discs with a tangential force so that said cycle discs are dovetailed with said date ring and rotate along an inner edge of the date ring.

2. The human biorhythms calculating devices according to claim 1, wherein said calendar scale corresponds to months and days of a non-leap year and the number of internal teeth of said date ring is identical with the number of days of a non-leap year.

3. The human biorhythms calculating device according to claim 1, wherein each said number of external teeth on each said cycle discs being an even multiple of the number of days in the related biorhythm cycle.

4. The human biorhythms calculating device according to claim 1, wherein all said cycle discs have the same distance between an edge of the central hole and an outer edge of said cycle disc, so that all said cycle discs, when activated by the pushing piece placed through the central holes, will be dovetailed with said date ring during simultaneous rotational movements.

5. The human biorhythms calculating device according to claim 1, wherein said biorhythm curve of each of said cycle discs include a closed multi-wave curve distributed on a base circle, with every positive semi-circle, negative semi-circle and point where the curve intersects the base circle representing respectively a high tide, low tide and critical day of the related biorhythm cycle.

6. The human biorhythms calculating device according to claim 1, wherein a diameter of the inner circle of said date ring is longer than a diameter of the outer circle of a largest of said cycle discs, so that said date ring will have enough space to accommodate said cycle discs and enabling said cycle discs to rotate freely within said date ring.

7. The human biorhythms calculating device according to claim 1, wherein the age scale on said cycle discs includes a number of years corresponding to a human beings maximal life expectancy and the year-lines are arranged wherein the number of external teeth between two adjacent year-lines varies, as required for compensation for a leap year.

8. The human biorhythms calculating device according to claim 1, wherein said cylindrical pushing piece placed through the central holes of said cycle discs applies a slight force to a surface of said base disc for maintaining said cycle discs in steady position.

9. The human biorhythms calculating device according to claim 1, wherein said cycle discs are transparent so that, when the cycle discs are superimposed and set in rotatory motion, the overlapping biorhythm curves will be indicated clearly and the biorhythm changes detected at a glance, over a period of one year or more than one year as said cycle discs rotate simultaneously within said date ring.

10. The human biorhythms calculating device according to claim 1, wherein the number of the sets of said cycle discs within said date ring is determined wherein one set detects a single person's biorhythm levels, two sets detects two partners combined biorhythm levels, and several sets of cycle discs detect several persons combined levels regarding a particular biorythm.

11. The human biorhythms calculating device according to claim 1, wherein the curves and scales on said cycle discs are in different colours for distinct indication.

12. The human biorhythms calculating device as defined in claim 1, and further including a cover for a body of the calculating device.

13. The human biorhythms calculating device according to claim 1, wherein several cycle discs of a predetermined biorhythm are superimposed within said date ring.

* * * * *